US006168444B1

(12) United States Patent
Wu et al.

(10) Patent No.: US 6,168,444 B1
(45) Date of Patent: Jan. 2, 2001

(54) VACUUM SUCTION PICK-UP DEVICE MOUNTABLE TO ELECTRICAL CONNECTOR

(75) Inventors: Ming- Chuan Wu, Shu-Lin; Ching-Ho Lai, Ta-His, both of (TW)

(73) Assignee: Hon Hai Precision Ind. Co., Ltd., Taiepi Hsien (TW)

( * ) Notice: Under 35 U.S.C. 154(b), the term of this patent shall be extended for 0 days.

(21) Appl. No.: 09/332,768

(22) Filed: Jun. 14, 1999

(30) Foreign Application Priority Data

Dec. 15, 1998 (TW) ..... 87220863

(51) Int. Cl.[7] ..... H01R 13/44
(52) U.S. Cl. ..... 439/135; 439/940
(58) Field of Search ..... 439/135, 940

(56) References Cited

U.S. PATENT DOCUMENTS 5,681,174 * 10/1997 Correll, Jr. et al. ..... 439/135
6,019,617 * 2/2000 Liu et al. ..... 439/135

* cited by examiner

*Primary Examiner*—Lincoln Donovan
*Assistant Examiner*—Brian S. Webb
(74) *Attorney, Agent, or Firm*—Wei Te Chung

(57) ABSTRACT

A pick-up device is mountable to an electrical connector for facilitating pneumatic handling thereof. The connector has a receiving slot defined by two side walls and a bottom wall connecting therebetween. The pick-up device includes a base plate having a substantially flat top face engageable by a suction cup and a bottom face positioned on top edges of the side walls of the connector. A post extends from the bottom face of the base plate and is inserted into the receiving slot with a free end thereof received in and interferentially engaging with a bore defined in the bottom wall of the connector thereby securing the pick-up device to the connector. The pick-up device may further include two resilient arms extending from the bottom face of the base plate on opposite sides of the post. Each resilient arm has a J-shaped free end for engaging with a corresponding hole defined in the bottom wall of the connector. Each J-shaped free end has an inclined section for guiding the free end into the corresponding hole. The bottom face of the base plate forms contacting means engaging with inside faces of the side walls for firmly supporting the pick-up device on the connector.

15 Claims, 12 Drawing Sheets

VACUUM SUCTION PICK-UP DEVICE MOUNTABLE TO ELECTRICAL CONNECTOR

BACKGROUND OF THE INVENTION

1. Field of the Invention

The present invention generally relates to a pick-up device for mounting to an electrical connector to facilitate pneumatic handling of the connector.

2. The Prior Art

Using vacuum suction to support and transfer an electrical connector is well known in the electronics field. A vacuum suction device for picking up and handling the electrical connector usually comprises a suction cup in physical contact with the electrical connector to apply a suction force thereto. The physical contact between the suction cup and the electrical connector requires a substantial flat surface on the electrical connector. Since most connectors do not have a flat surface, a pick-up member is releasably mounted to the connector to provide the flat surface.

Several types of pick-up members are currently available. Examples are disclosed in U.S. Pat. Nos. 4,396,245, 5,688,133 and 5,249,977 and are respectively shown in FIGS. 1–3 of the attached drawings. FIG. 1 shows a conventional pick-up member 55 comprising a central projection 551 which is inserted into an electrical connector 5 and pinched by resilient contact elements 51, 52 located on two opposite sides thereof thereby securing the pick-up member 55 to the connector 5. FIG. 2 shows another conventional pick-up member 61 comprising two opposite pairs of resilient legs 62, 63 simultaneously engaging inside and outside faces of two opposite side walls of a connector 6, respectively, thereby securing the pick-up member 61 to the connector 6. FIG. 3 shows a further conventional pick-up member 71 comprising two legs 72 engaging with two opposite faces of an internal wall 70 of an electrical connector 7 thereby securing the pick-up member 71 to the connector 7.

There are, however, other ways to secure a pick-up member to an electrical connector and the present invention is aimed to provide a different type of pick-up member for facilitating pneumatic handling of an electrical connector.

SUMMARY OF THE INVENTION

Accordingly, an object of the present invention is to provide a pick-up device releasably mountable to an electrical connector for facilitating pneumatic handling of the connector.

Another object of the present invention is to provide a pick-up device comprising positioning arms for properly positioning the pick-up device on an electrical connector and more securely retaining the pick-up device on the connector.

To achieve the above objects, a pick-up device in accordance with the present invention is mountable to an electrical connector forming a receiving slot defined by two side walls and a bottom wall connecting therebetween for facilitating pneumatic handling of the connector. The pick-up device comprises a base plate having a substantially flat top face engageable by a suction cup and a bottom face positioned on top edges of the side walls of the connector. A post extends from the bottom face of the base plate and is inserted into the receiving slot with a free end thereof received in and interferentially engaging with a bore defined in the bottom wall of the connector thereby securing the pick-up device to the connector. The pick-up device may further include two resilient arms extending from the bottom face of the base plate on opposite sides of the post. Each resilient arm has a J-shaped free end engaging with a corresponding hole defined in the bottom wall of the connector. Each J-shaped free end has an inclined section for guiding the free end into the corresponding hole. The bottom face of the base plate forms contacting means engaging with inside faces of the side walls for firmly supporting the pick-up device on the connector.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
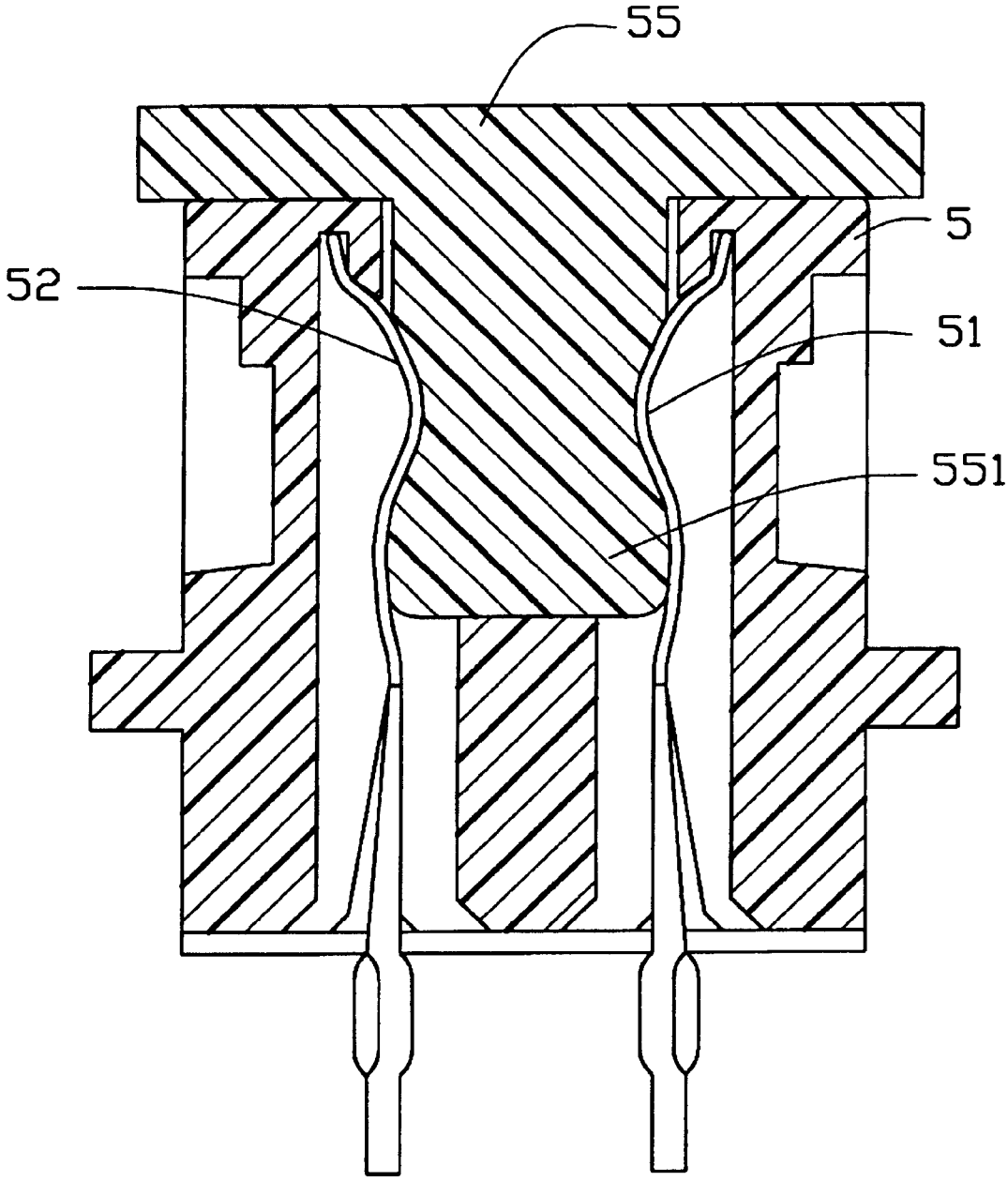
FIG. 1 (PRIOR ART)
FIG. 1 is a cross-sectional view of a conventional pick-up member mounted to an electrical connector.
Figure 2:
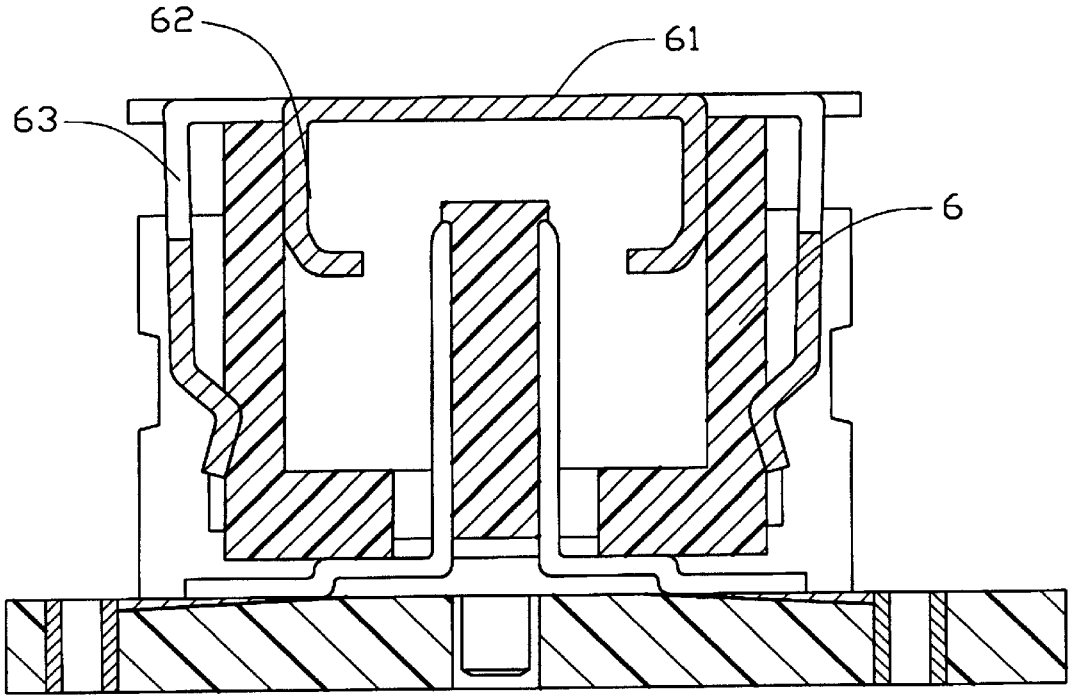
FIG. 2 (PRIOR ART)
FIG. 2 is a cross-sectional view of another conventional pick-up member mounted to an electrical connector.
Figure 3:
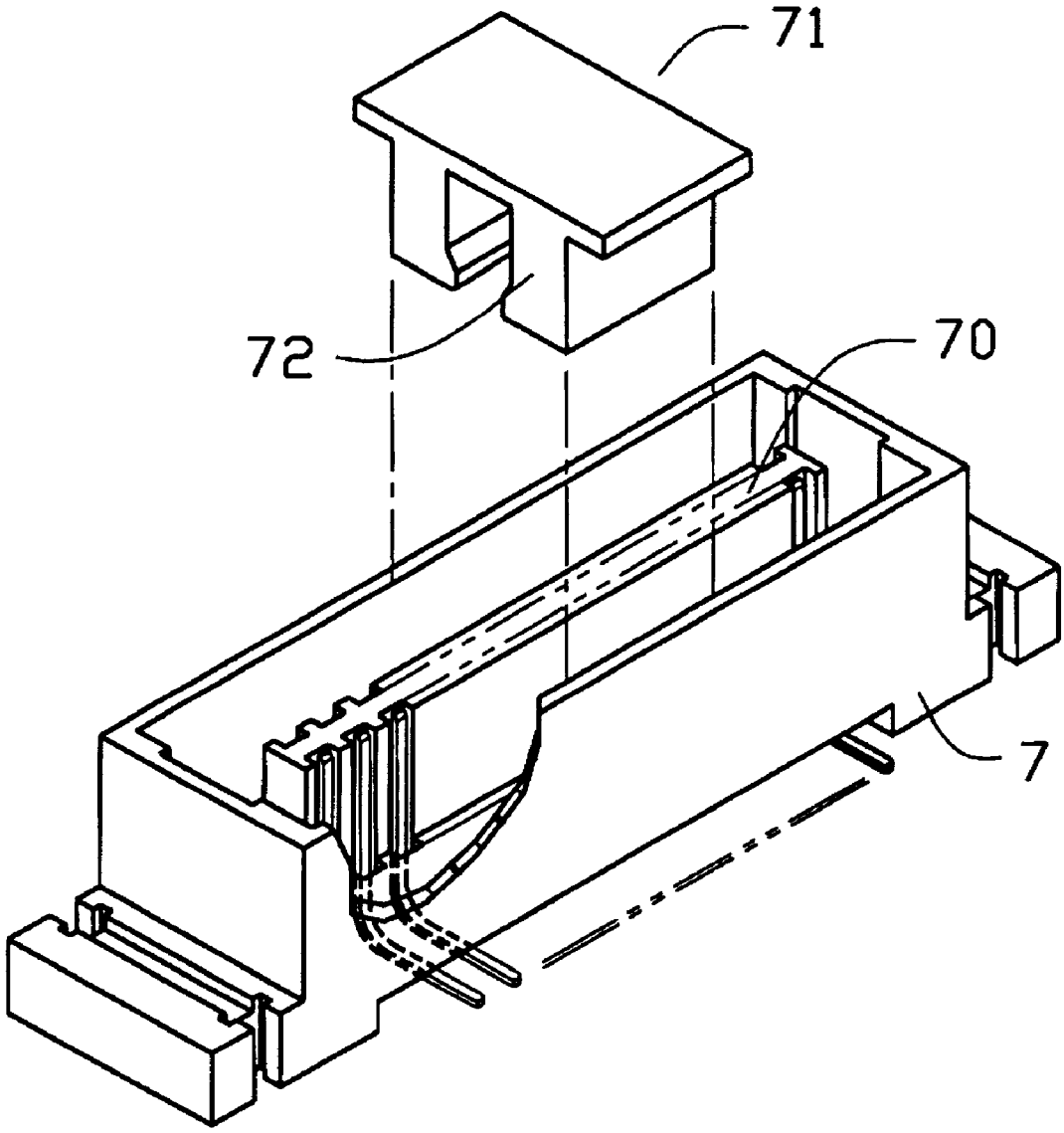
FIG. 3 (PRIOR ART)
FIG. 3 is a perspective view of a further conventional pick-up member and an electrical connector to which the pick-up member is to be mounted.
Figure 4:
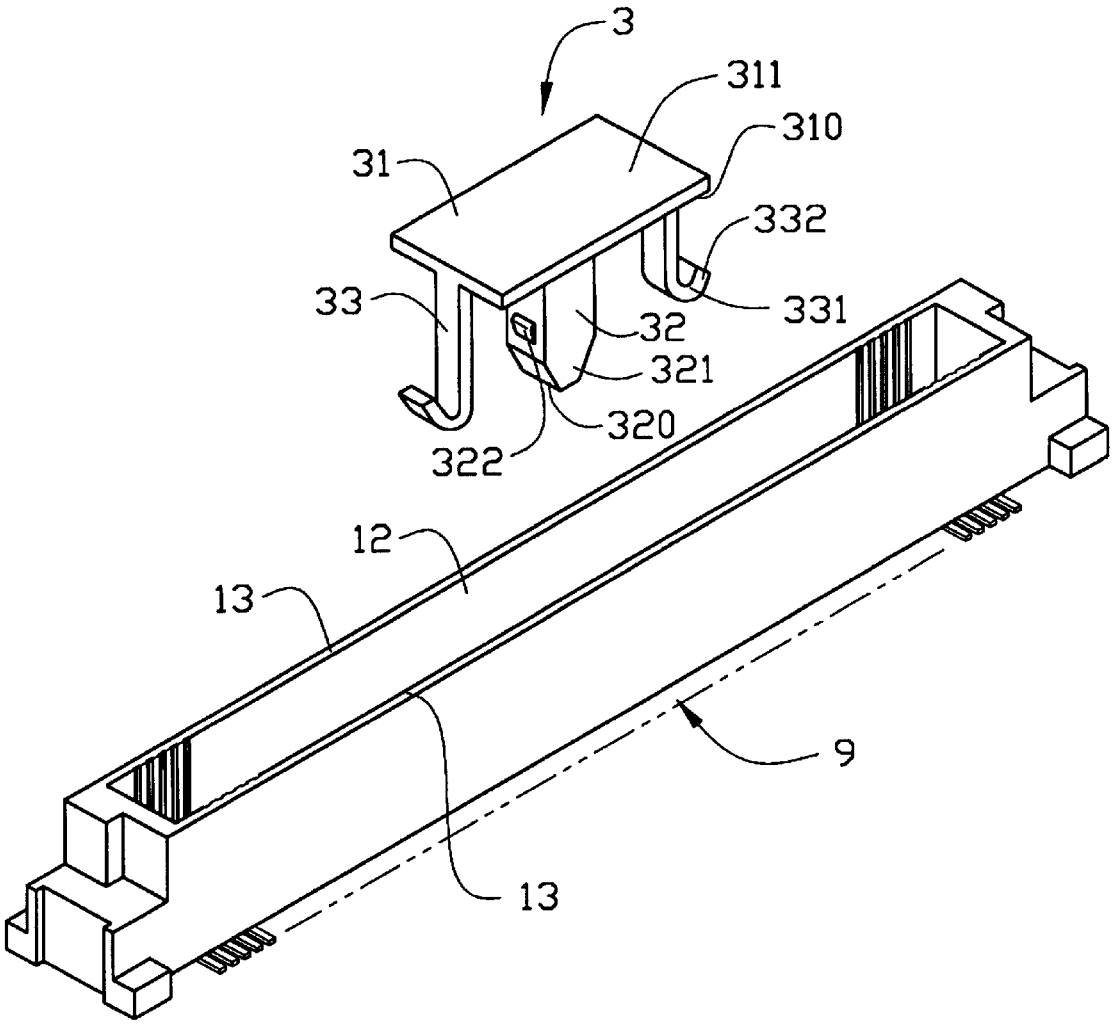
FIG. 4 is a perspective view of a pick-up device constructed in accordance with a first embodiment of the present invention and an electrical connector to which the pick-up device is to be mounted.
Figure 5:
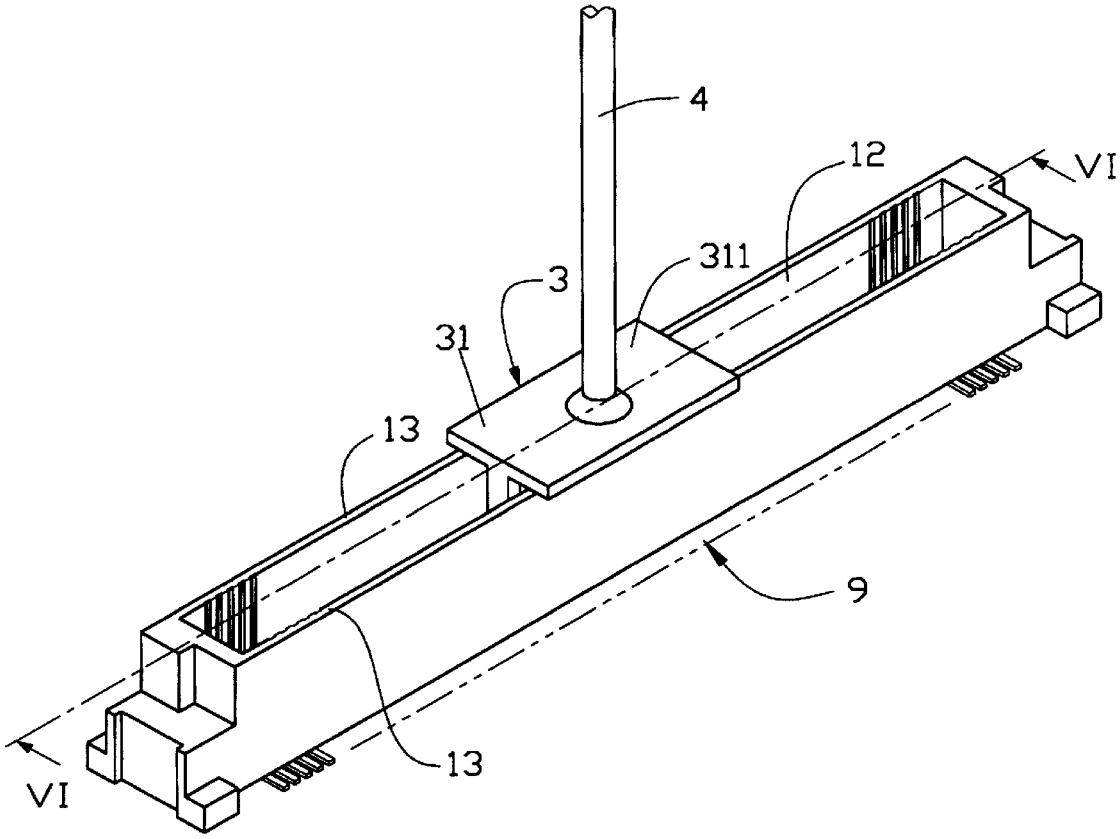
FIG. 5 is a perspective view of the pick-up device mounted to the connector of FIG. 4.
Figure 6:
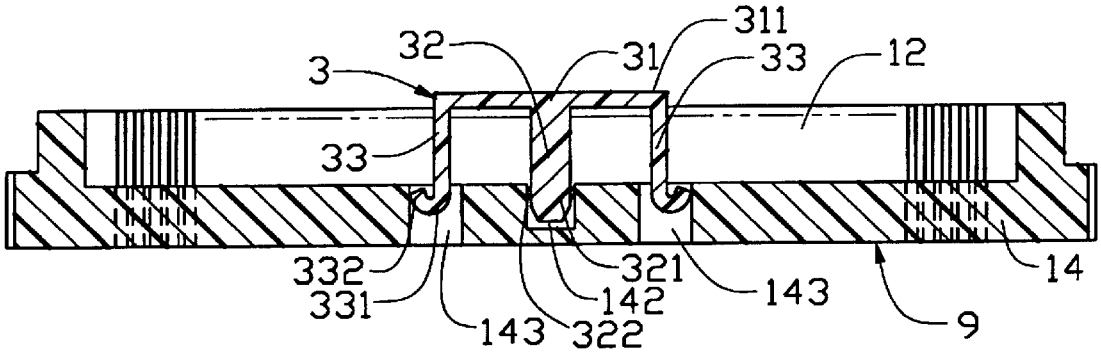
FIG. 6 is a cross-sectional view taken along line VI—VI of FIG. 5.

Referring to the drawings and in particular to FIGS. 4–6, a pick-up device 3 constructed in accordance with the present invention is mounted to an electrical connector 9 to facilitate pneumatic handling of the connector 9. The pick-up device 3 comprises a base plate 31 having a top face 311 defining a substantially flat surface adapted to be engaged by a vacuum suction cup 4 and an opposite bottom face 310 from which a retaining post 32 extends. The post 32 is inserted into a receiving slot 12 defined between two side walls 13 of the connector 9 whereby a free end 321 of the post 32 is interferentially received in a bore 142 defined in a bottom wall 14 of the connector 9 with the bottom face 310 of the base plate 31 contacting and being supported by top edges of the side walls 13 of the connector 9 thereby securing the pick-up device 3 to the connector 9.

Preferably, the free end 321 of the post 32 has converging side faces 320 for facilitating insertion of the free end 321 into the bore 142. If desired, the post 32 may comprise projections 322 formed thereon for strengthening interferential engagement with the bore 142 (FIG. 6).

The pick-up device 3 may further comprise two resilient positioning arms 33 extending from the bottom face 310 of the base plate 31 on opposite sides of the post 32 in a longitudinal direction of the base plate 31. Each positioning arm 33 has a J-shaped free end 331 engaging with a corresponding hole 143 defined in the bottom wall 14 of the connector 9 thereby more securely retaining the pick-up device 3 on the connector 9. The J-shaped free end 331 comprises an inclined section 332 which contacts and deforms when inserting the positioning arms 33 into the holes 143 thereby being guided to properly position the pick-up device 3 with respect to the connector 9.

Figure 7:
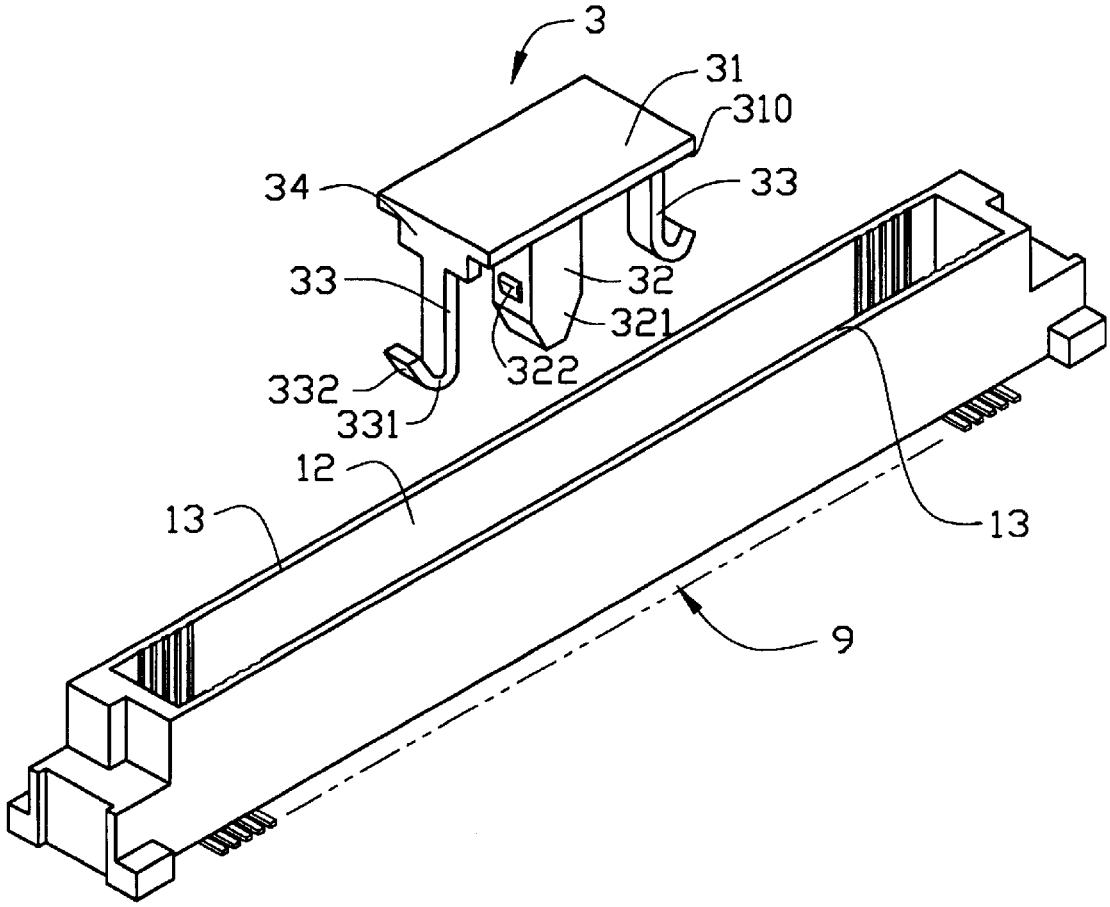
FIG. 7 is a perspective view of a pick-up device constructed in accordance with a second embodiment of the present invention and an electrical connector to which the pick-up device is to be mounted.
Figure 8:
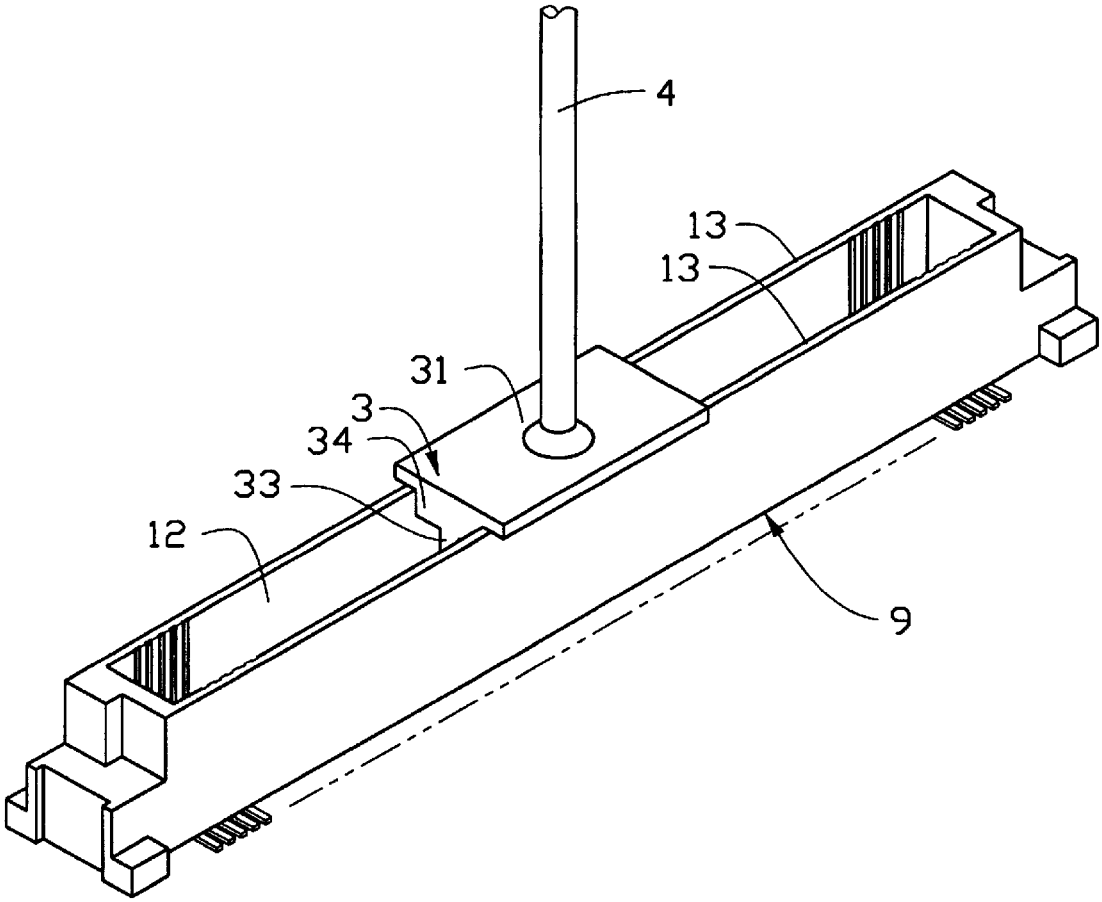
FIG. 8 is a perspective view of the pick-up device mounted to the connector of FIG. 7.

In the embodiment illustrated in FIGS. 4–6, the pick-up device 3 is firmly supported on the connector 9 by means of direct contact between the bottom face 310 of the base plate and the side walls 13 of the connector 9. However, it is possible to more firmly support the pick-up device 3 on the connector 9 as illustrated by a second embodiment of the present invention shown in FIGS. 7 and 8, wherein like reference numerals designate the same or similar parts and the descriptions thereof are omitted for simplicity. The pick-up device 3 comprises an expanded section 34 formed between each positioning arm 33 and the bottom face 310 of the base plate 31. The expanded section 34 has a width substantially corresponding to a distance between the side walls 13 of the connector 9 whereby when the pick-up device 3 is inserted into the receiving slot 12 of the connector 9, opposite edges of the expanded section 34 engage with inside faces of both side walls 13 of the connector 9. This, together with the contact between the bottom face 310 of the pick-up device 3 and the top edges of the side walls 13, more firmly supports the pick-up device 3 on the connector 9.

Figure 9:
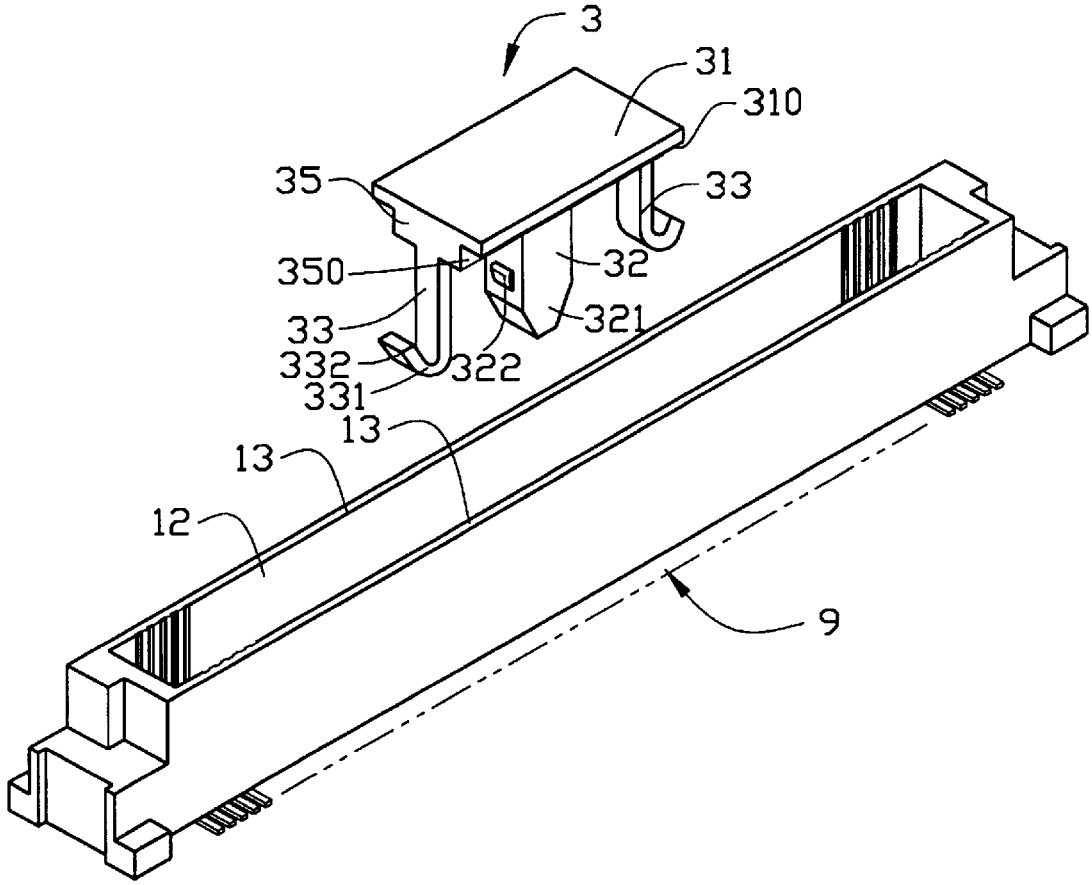
FIG. 9 is a perspective view of a pick-up device constructed in accordance with a third embodiment of the present invention and an electrical connector to which the pick-up device is to be mounted.
Figure 10:
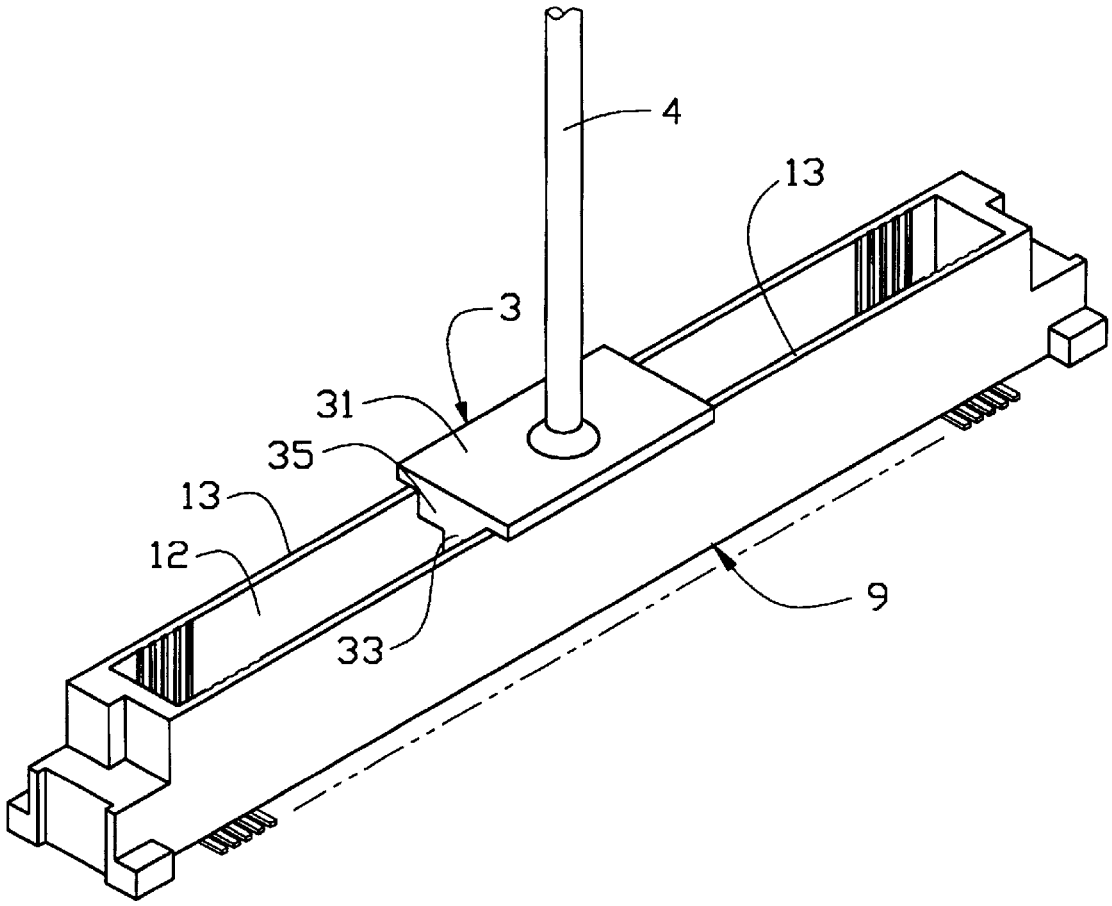
FIG. 10 is a perspective view of the pick-up device mounted to the connector of FIG. 9.

As an expansion of the second embodiment and illustrated by a third embodiment shown in FIGS. 9 and 10, wherein like reference numerals designate the same or similar parts and the descriptions thereof are omitted for simplicity, the expanded section 34 of the pick-up device 3 of the second embodiment may be extended along the bottom face 310 of the base plate 31 to form a block 35 having two opposite side faces 350 engaging with the inside faces of the side walls 13 of the connector 9 when the pick-up device 3 is inserted into the receiving slot 12 of the connector 9.

Figure 11:
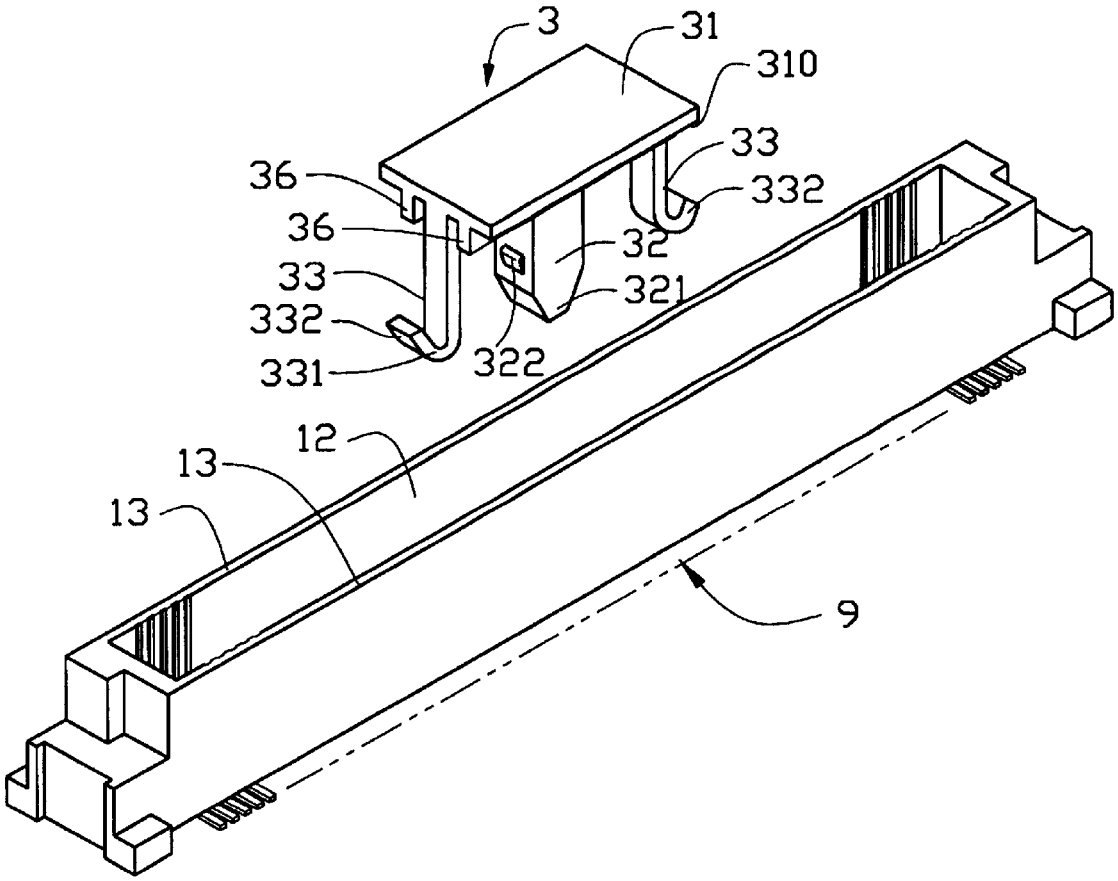
FIG. 11 is a perspective view of a pick-up device constructed in accordance with a fourth embodiment of the present invention and an electrical connector to which the pick-up device is to be mounted.
Figure 12:
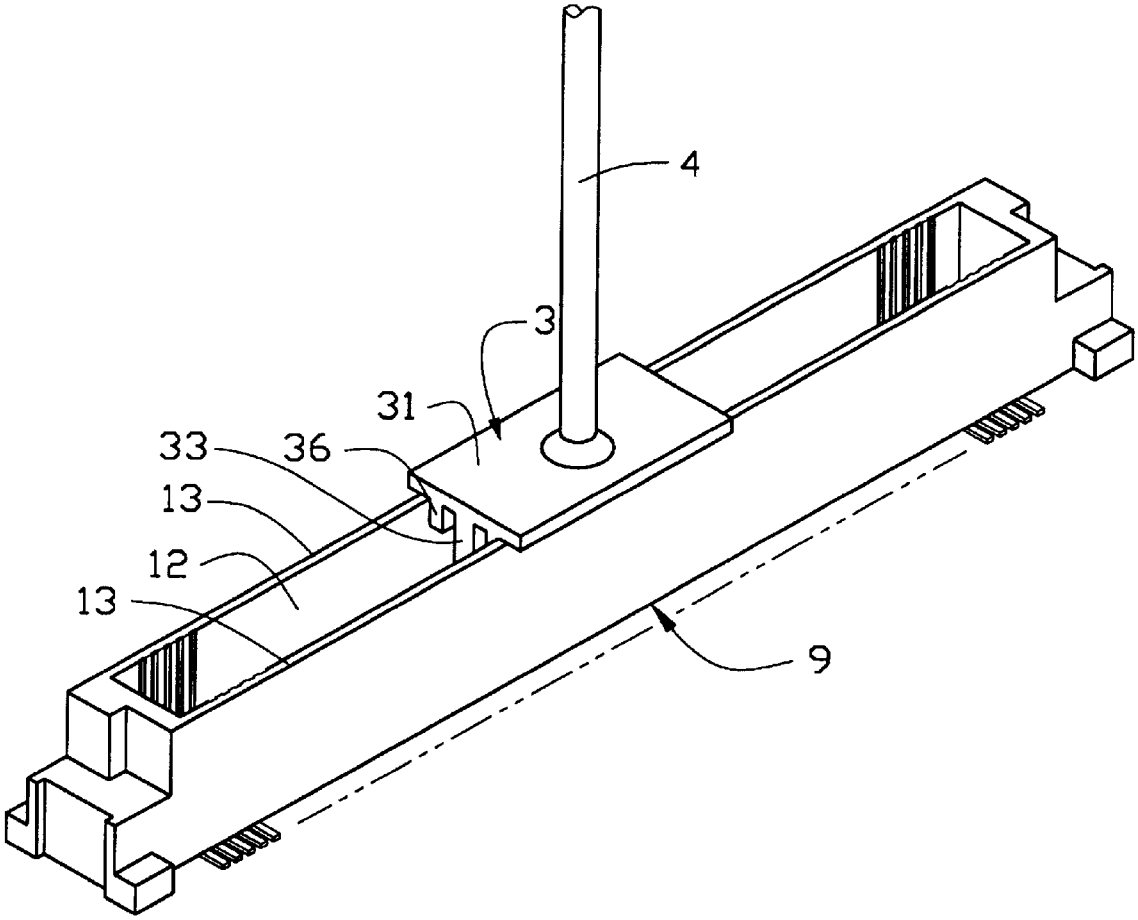
FIG. 12 is a perspective view of the pick-up device mounted to the connector of FIG. 11.

An alternative embodiment is shown in FIGS. 11 and 12, wherein like reference numerals designate the same or similar parts and the descriptions thereof are omitted for simplicity. In the embodiment shown in FIGS. 11 and 12, the pick-up device 3 comprises two projections 36 extending from the bottom face 310 of the base plate 31 on opposite sides of the positioning arms 33 in a transverse direction. The projections 36 engage with the inside faces of the side walls 13 of the connector 9 when the pick-up device 3 is inserted into the receiving slot 12 of the connector 9.

Although the present invention has been described with reference to preferred embodiments, it is apparent to those skilled in the art that a variety of modifications and changes may be made without departing from the scope of the present invention which is intended to be defined by the appended claims.

What is claimed is:

1. A pick-up device adapted to be mounted to an electrical connector having a receiving slot defined by two side walls and a bottom wall connecting between the side walls for facilitating pneumatic handling of the connector, comprising a base plate having a substantially flat top face adapted to be engaged by vacuum suction means and an opposite bottom face from which a post extends, and contacting means formed on the bottom face for engaging with the side walls of the connector to firmly support the pick-up device on the connector, the post being insertable into the receiving slot of the connector and having a free end received in and interferentially engaging with a first hole defined in the bottom wall of the connector thereby securing the pick-up device to the connector, the contacting means including a block which has two side faces engaging with the inside faces of the side walls of the connector.

2. The pick-up device as claimed in claim 1, wherein the free end of the post has converging side faces for facilitating engagement with the first hole.

3. The pick-up device as claimed in claim 1, wherein the post comprises projections formed proximate the free end thereof for strengthening the interferential engagement between the free end with the first hole.

4. The pick-up device as claimed in claim 1 further comprising two resilient arms extending from the bottom face of the base plate on opposite sides of the post, each resilient arm having a free end engaging with a corresponding second hole defined in the bottom wall of the connector.

5. The pick-up device as claimed in claim 4, wherein the free end of each resilient arm comprises a bent section having an inclined face for guiding the resilient arm into the corresponding second hole of the connector.

6. The pick-up device as claimed in claim 4, wherein the free end of each resilient arm comprises a deformable section for interferentially engaging with the corresponding second hole of the connector to more securely retain the pick-up device on the connector.

7. The pick-up device as claimed in claim 1, wherein the contacting means comprises the bottom face of the base plate contacting top edges of the side walls of the connector.

8. The pick-up device as claimed in claim 1, wherein the contacting means comprises two projections formed on the bottom face of the base plate for engaging with the inside faces of the side walls of the connector.

9. The pick-up device as claimed in claim 1, wherein the contacting means comprises two ribs formed on the bottom face of the base plate on opposite sides of the post, each rib having an edge engaging with the inside face of the corresponding side wall of the connector.

10. The pick-up device as claimed in claim 1, wherein the contacting means comprises an expanded portion extending along the bottom face of the base plate for fitting with the inner faces of the side walls.

11. A pick-up device adapted to be mounted to an electrical connector having a receiving slot defined by two side walls and a bottom wall connecting between the side walls for facilitating pneumatic handling of the connector, comprising a base plate having a substantially flat top face adapted to be engaged by vacuum suction means and an opposite bottom face from which two resilient arms extend, the resilient arms being insertable into the receiving slot of the connector and each having a free end received in and interferentially engaging with a corresponding hole defined in the bottom wall of the connector thereby securing the pick-up device to the connector, the base plate forming contacting means on the bottom face thereof for engaging with the side walls of the connector to firmly support the pick-up device thereon, the contacting means comprising a block which has opposite side faces engaging with the inside faces of the side walls.

12. The pick-up device as claimed in claim 11, wherein the end of each resilient arm comprises a bent section having an inclined face for guiding the resilient arm into the corresponding hole of the connector.

13. The pick-up device as claimed in claim 11, wherein the contacting means comprises two projections formed on the bottom face of the base plate on opposite sides of each resilient arm for engaging with the inside face of the corresponding side wall of the connector.

14. The pick-up device as claimed in claim 11, wherein the contacting means comprises an expanded section formed on each resilient arm and having two edges engaging with the inside faces of the side walls of the connector.

15. A connector assembly for use with a vacuum suction means comprising: an electrical connector having a longitudinal slot defined by two side walls and a bottom wall; and a pick-up device comprising a base plate with a flat top face adapted to be engaged by the vacuum suction means and an opposite bottom face from which means for securing the pick-up device to the connector downward extends into the slot and is interferentially engaged within the bottom wall of the connector;

wherein the means is arranged along the longitudinal direction of the bottom face, the means having a first portion engaging with the bottom wall and a second portion engaging with the side walls.

* * * * *